United States Patent [19]

Sapkus et al.

[11] 4,135,327

[45] Jan. 23, 1979

[54] DOLL CONSTRUCTION WITH PIVOTABLE TORSO MEMBERS

[75] Inventors: Jurgis Sapkus, Manhattan Beach; J. Stephen Lewis, Pacific Palisades, both of Calif.

[73] Assignee: Mattel, Inc., Hawthorne, Calif.

[21] Appl. No.: 812,121

[22] Filed: Jul. 1, 1977

[51] Int. Cl.[2] ..... A63H 3/20

[52] U.S. Cl. ..... 46/161; 46/173

[58] Field of Search ..... 46/161, 162, 163, 151, 46/119, 120, 173

[56] References Cited

U.S. PATENT DOCUMENTS

| | | | |
|---|---|---|---|
| 130,068 | 7/1872 | Parent | 46/161 |
| 1,876,433 | 9/1932 | Sanders | 46/161 |
| 2,783,587 | 3/1957 | Gardel et al. | 46/173 |
| 2,807,119 | 9/1957 | Beebe | 46/161 |
| 2,925,683 | 2/1960 | Cohn | 46/173 |
| 3,010,253 | 11/1961 | Ostrander | 46/161 |
| 3,277,602 | 10/1966 | Speers et al. | 46/161 |
| 3,425,155 | 2/1969 | Ryan et al. | 46/162 |
| 3,628,282 | 12/1971 | Johnson et al. | 46/161 |
| 3,634,966 | 1/1972 | Ostrander | 46/161 |
| 3,637,940 | 5/1972 | Fugitt | 46/161 |
| 3,690,030 | 9/1972 | Garcia et al. | 46/161 |
| 3,740,894 | 6/1973 | Howland et al. | 46/161 |
| 3,921,332 | 11/1975 | Terzian et al. | 46/161 |
| 3,928,934 | 12/1975 | Lewis et al. | 46/119 |
| 3,942,284 | 3/1976 | Kublan | 46/161 |

FOREIGN PATENT DOCUMENTS

| | | | |
|---|---|---|---|
| 964855 | 3/1975 | Canada | 46/119 |

*Primary Examiner*—Russell R. Kinsey
*Assistant Examiner*—Mickey Yu
*Attorney, Agent, or Firm*—John G. Mesaros; Max E. Shirk; Ronald M. Goldman

[57] ABSTRACT

A doll construction having upper and lower generally hollow torso members adapted to be supported in an upright position along the longitudinal center line of the doll and to be pivoted with respect to each other about an axis disposed angularly at approximately 30° from the longitudinal center line. Mating coacting ball and socket means are provided at the connecting midriff portions of the torsos and a flexible connector extends through a bushing aperture formed integrally with the ball to define the axis of pivoting, the connector being fixedly secured within one torso member and rotatably secured within the other, the connector maintaining the portions together under tension with the pivotal connection providing a large range of compound positions and relationships between the upper and lower torsos of the doll.

6 Claims, 8 Drawing Figures

8
14
30
30°
56
46
54
50
42
38
48
40
44
12
51
16
20
22
24
26
60
28
62
58
18

DOLL CONSTRUCTION WITH PIVOTABLE TORSO MEMBERS

BACKGROUND OF THE INVENTION

The background of the invention will be discussed in two parts:

Field of the Invention

This invention relates to doll construction and more particularly to a doll construction having upper and lower torso members pivotal relative to each other.

Description of the Prior Art

Doll construction having upper and lower torso members movable or pivotable relative to each other have taken many forms. Generally, one basic intent in the construction of such dolls is to simulate lifelike movement of bending or twisting at the midriff or waist portion of the doll to "pose" the doll in as realistic a manner as possible. Some such doll construction, such as shown in U.S. Pat. Nos. 3,921,332 and 3,942,284 utilize an intermediate element connected between the upper and lower torsos with elastic or resilient members extending through enlarged openings in the so-connected members to permit a degree of freedom of movement of the parts.

Another doll construction which simulates lifelike twisting movement at the waist is shown and described in U.S. Pat. No. 3,425,155 in which the upper and lower torso members have planar configuration at the connecting portion, the planes being inclined with respect to the longitudinal center line of the doll at an angle from front to rear and at a second angle from side to side to provide a compound plane of movement, the two parts being interconnected by connecting means formed integral with one of the torso members.

Another doll construction having the upper torso and lower torso pivotable with respect to each other is shown and described in U.S. Pat. No. 3,740,894 which utilizes a ball and socket connection, the surface of the ball being slotted with a rigid connector element having the bottom thereof pivotally secured within the lower torso about a front to rear axis with a shank portion extending through a slot in the ball, the upper end of the connector having an enlarged beveled head portion for insertion through an aperture formed in the socket surface of the upper torso. The upper torso is pivotable from side to side within the slot and is rotatable with respect to a neck portion of the shank.

In the prior art devices utilizing intermediate members with enlarged openings, such dolls can be contorted into awkward positions not lifelike in form. With other dolls utilizing rigid connector elements to define the axis of pivoting at the interconnecting waist portion, the possibility of breakage of the connector or separation of the two torso members with respect to each other exists if a child abuses a toy. Such rigid connector elements are generally press fit into an aperture in the opposing torso member which sometimes renders it difficult to rejoin the parts if inadvertently disassembled.

It is an object of the present invention to provide a new and improved doll construction for pivotally joining upper and lower torso members.

It is another object of this invention to provide a new and improved torso coupling which permits movement of the torso members relative to each other to simulate lifelike positions.

It is a further object of this invention to provide a doll construction utilizing a generally flexible connector for maintaining the torso portions in relation under tension while permitting relative pivotal movement between the parts.

SUMMARY OF THE INVENTION

The foregoing and other objects of the invention are accomplished by providing a doll construction having upper torso means with a midriff portion and lower torso means with a midriff portion, one of the torso means having ball means formed at the midriff portion thereof with the other midriff portion having mating coacting socket means. Connecting means are provided and extend through an aperture in the ball means, the connecting means being adapted for securing, under tension, the upper torso means to the lower torso means in a normally aligned upright relation with the longitudinal center lines of both the upper and lower torso means being in substantial alignment. The connecting means include a flexible connector extending through the aperture in the ball along a line at an angle to the longitudinal center line, the connector being fixedly secured within the torso means containing the ball portion and rotatably secured within the other torso means to permit relative pivotal movement along the line through the connector. The aperture through which the connector passes is a circular bearing surface for matingly coacting with the shank of the connector.

Other objects, features and advantages of the invention will become apparent upon a reading of the specification when taken in conjunction with the drawings in which like reference numerals refer to like elements in the several views.

DESCRIPTION OF THE PREFERRED EMBODIMENT

Figure 1:
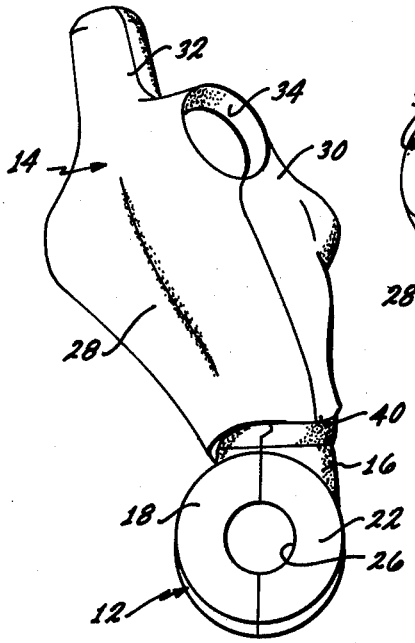
FIG. 1 is a right end view of the doll construction according to the invention showing the upper torso rotated counterclockwise with respect to the lower torso.
Figure 2:
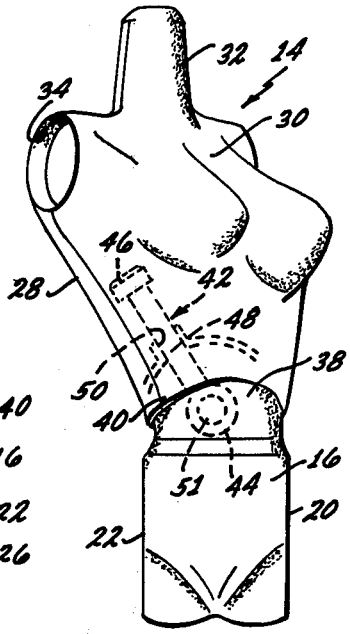
FIG. 2 is a front view of the doll construction of FIG. 1 with the parts in the same relative position.
Figure 3:
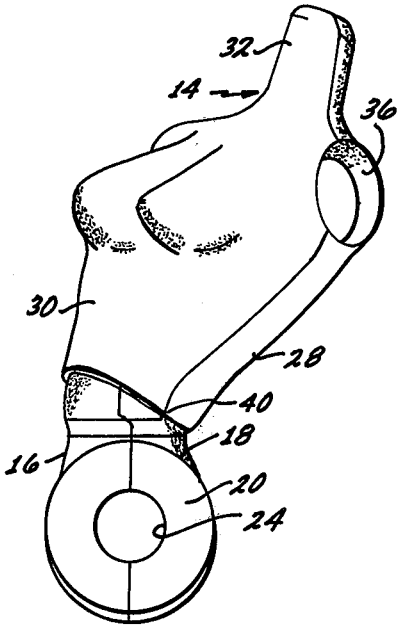
FIG. 3 is a left end view of FIG. 1 as viewed from the other side.

Referring now to the drawings and particularly to FIGS. 1-3, there is shown a doll construction including a lower torso member generally designated 12 and an upper torso member generally designated 14, the upper torso member 14 being pivotally secured to the lower torso member 12. The lower torso member 12 includes a front half 16 and a rear half 18 suitably interconnected with opposite surfaces 20 and 22 thereof being generally planar and having centrally aligned apertures 24 and 26, respectively, formed therein for suitably receiving the hip connection means of leg members (not shown).

The upper torso member 14 is likewise generally hollow and formed from two halves or shells including a rear half 28 and a front half 30 suitably joined and configured to form the chest and back surfaces of the doll. The upper portion of the upper torso terminates in a neck projection 32 to which is suitably secured a head (not shown). The rear and front torso halves 28 and 30 are also configured to provide socketed arm openings 34 and 36 adjacent the shoulder edges thereof for suitably receiving arm members (not shown).

The upper surface of the lower torso member 12 terminates in a ball surface 38 at the midriff or waist portion of the lower torso member 12 where the two torso member portions are interconnected. The upper torso member 14, as will hereinafter be described, terminates in a skirt portion 40, which defines the waist or midriff portion thereof, the skirt portion 40 having an arcuately figure peripheral edge forming socket means to matingly coact and slide with respect to the ball surface 38. As shown in dotted lines in FIG. 2, a connecting member 42 has a washer-like end 44 and an enlarged head end 46 with an interconnecting shaft or shank portion 48. A bushing aperture 50 is formed in the ball surface 38 and angularly disposed at 30° with respect to the longitudinal center line of the lower torso member 12. The enlarged washer portion 44 of the connector 42 is fixedly secured to a pin 51 within the lower torso member 18 with the shank 48 extending in close abutting relation through the bushing aperture 50 for suitably broadly supporting the mid-portion of the shank 48. The enlarged head portion 46 is rotatably secured within the upper torso member 14 to enable rotation of the upper torso member 14 with respect to the lower torso member 12 about an axis extending generally through the center of the shank 48 of the connecting member 42.

As illustrated in FIGS. 1–3, the upper torso member 14 is rotated counterclockwise through an angle of approximately 15 to 25 degrees with respect to the lower torso member 12 resulting in an overall contour of the so-connected torso members 12 and 14 which effectively simulates a posed lifelike position with the back generally canted rearwardly of the longitudinal center line extending generally vertically through the center of the lower torso member 12. With this pose, a line extending through the centers of the arm socket openings 34 and 36 will be angularly disposed with the right arm socket 34 slightly higher than the left arm socket 36 with reference to an upright position of a doll utilizing a doll construction.

Figure 4:
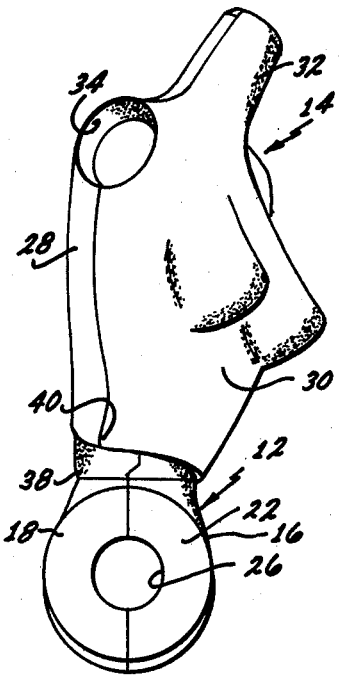
FIG. 4 is a right end view showing the doll construction with the upper torso rotated clockwise with respect to the lower torso.
Figure 5:
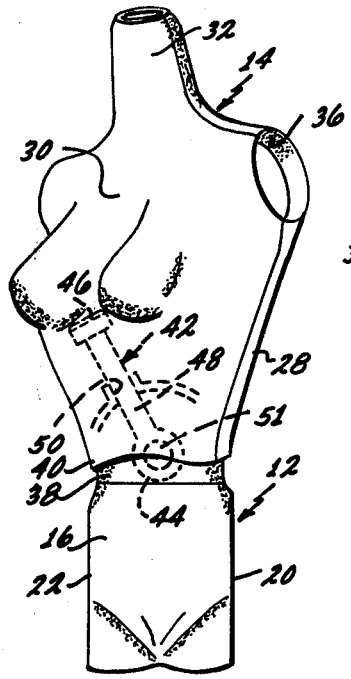
FIG. 5 is a front view of the doll construction of FIG. 4 with the parts thereof in the same relative position.
Figure 6:
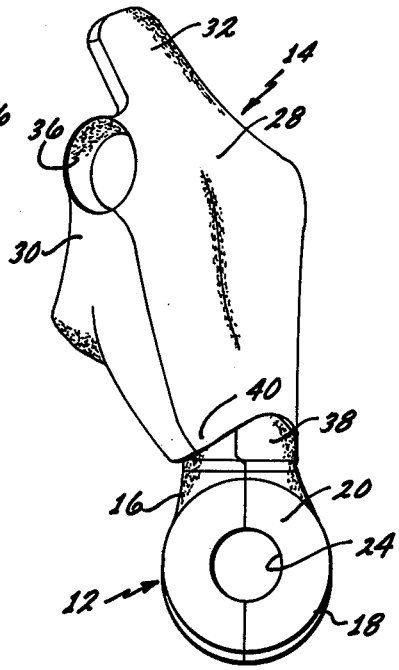
FIG. 6 is a left end view of the doll construction of FIG. 4 as viewed from the opposite side thereof.

FIGS. 4–6 show right end, front end, left end views of the same relative position of the doll torso members relative to each other with the upper torso member 14 rotated clockwise with respect to the lower torso member 12 through the same angle depicted in FIGS. 1–3. As can be seen by comparison of the views, as a consequence of the angularly disposed pivot axis defined by shank 48 of connecting member 42, the relative posed positions of the upper and lower torso members with respect to each other is different, with the longitudinal center line of the upper torso member 14 being disposed at an angle forwardly of the longitudinal center line of the lower torso member 12 to cant the upper torso member 14 forwardly at a less acute angle. Correspondingly, a line drawn between the centers of the arm sockets 34 and 36 will be angularly displaced only slightly relative to the angle created by rotation in the direction depicted in FIGS. 1–3. The degree of forward and rearward inclination of the upper torso member 14 with respect to the lower torso member 12 will be determined by the amount of offset of the pivot axis, that is, the angle between the center of the shank 48 of the connecting member 42 and a line drawn through the longitudinal center line of the lower torso member 12.

Figures 7, 8:
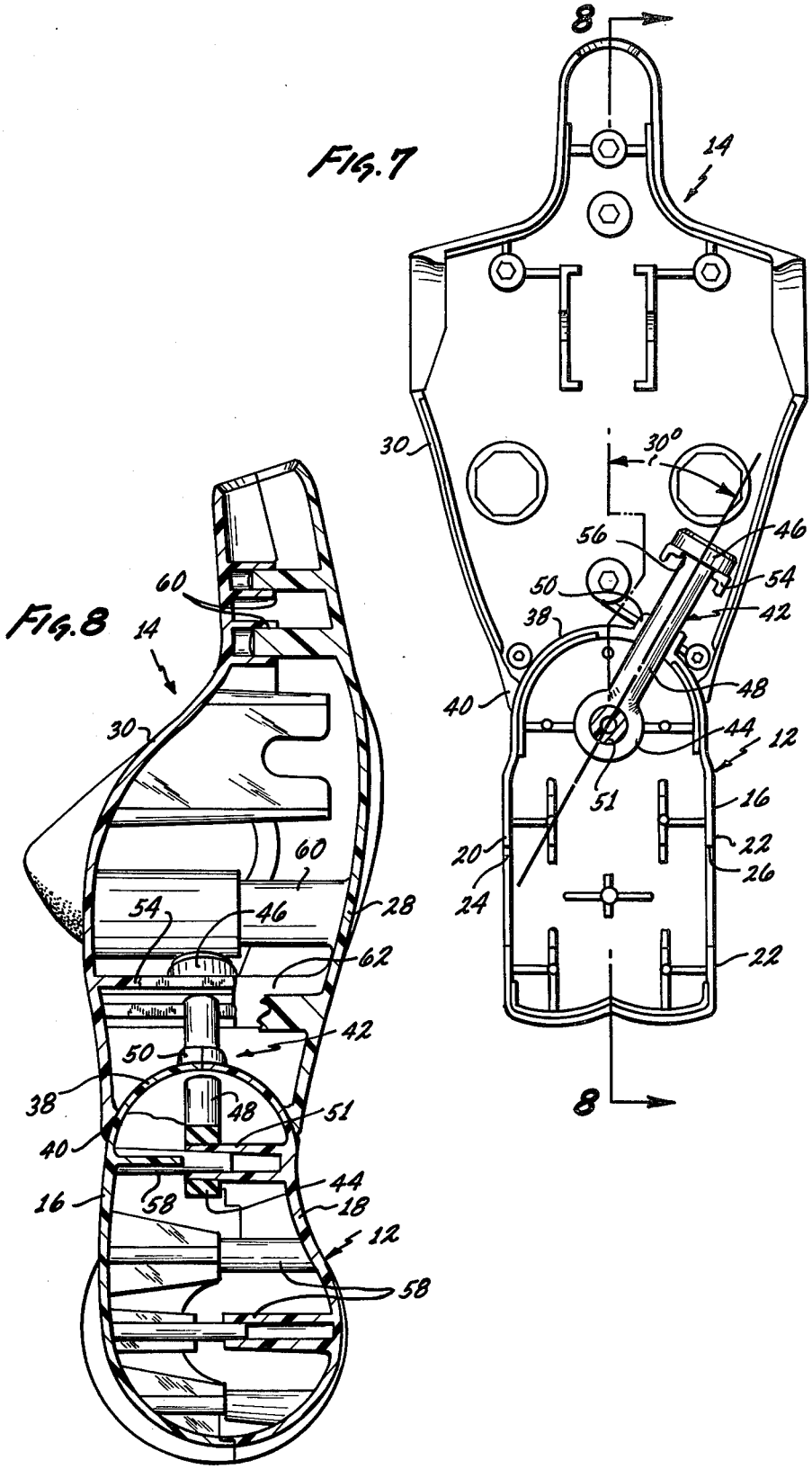
FIG. 7 is a rear plan view of the doll construction with the rear halves of the upper and lower torso members removed to illustrate the interior construction.
FIG. 8 is a cross-sectional view of the doll construction with the torsos fully assembled taken generally along line 8—8 of FIG. 7.

Referring now to FIGS. 7 and 8, the details of construction will be discussed. FIG. 7 illustrates the position of the parts during the assembly operation with the front torso half or shell 30 of the upper torso member 14 being positioned for access to the hollow interior thereof. Similarly, the front half 16 of the lower torso member 12 is positioned with the open hollow interior thereof accessible. As can be seen, the skirt portion 40 is suitably reinforced and arcuately configured to permit mating engagement with the ball surface 38 formed integrally with the lower torso member 12. The connector member 42 is a generally flexible neoprene member which has the washer end 44 thereof positioned over pin 51 of fixedly securing the connector member 42 thereto. For reference purposes the vertical line 8–8 extending through the centers of the upper torso members 14 and lower torso member 12 is the longitudinal center line previously referred to, and about which as viewed in the plan view of FIG. 7, the outer peripheral contours of the torso are symmetrical with respect thereto when the upper torso member 14 is upright with respect to the lower torso member 12 as depicted in FIGS. 7 and 8. This is the normal upright position of the doll. As can be seen, the pin 51 is generally disposed at the center of the ball surface 38 and on the longitudinal center line of the lower torso member 12. At some angle, in this case 30°, with respect to the longitudinal center line, the bushing aperture 50 is configured integrally with the ball surface 38 and the shank portion 48 of the connecting member 42 passes therethrough in close engagement. Extending generally perpendicular to the center line extending through shank 48, a support member 54 is formed integrally on the interior surface of the front torso half 30 of the upper torso member 14. The support member 54 has a generally planar upper surface and a cutout portion 56 at the free end thereof. The cutout 56 being arcuately configured for receiving therein a circular cross section portion of shank 48 with the enlarged head 46 of connecting member 42 having the undersurface thereof abuttingly engaging the planar surface of support member 54. During the assembly, the connecting member 42 is stretched until this engagement is effected with the socket means of a skirt portion 40 being maintained in abutting engagement with the ball surface 38 under tension due to the resilience of connecting member 42.

With the connecting member positioned as shown in FIG. 7, the rear half 18 of the lower torso member 12 is then assembled to the front half 16 by means of aligned pin and socket connector members 58 which can be suitably joined by welding or adhesive or the like. Similarly, the rear half 28 of the upper torso member 14 is secured to the front half 30 thereof by other pin and socket connectors 60. A projection 62 formed on the interior surface of the rear half 28 of upper torso member 14 is adapted to align with the cutout 56 of support member 54 for retention of the shank 48 of connector member 42 therein.

With the construction shown, the connecting member 42 maintains the upper torso 14 in tension with the lower torso member 12 with the peripheral skirt portion 40 of the upper torso matingly engaging the ball surface 38. With the connector member 42 being resilient and generally flexible and suitably supported at the midpoint thereof by support bushing aperture 50, the portion of shank 48 extending upwardly from the bushing aperture 50 is free to bend or flex without breaking if a child attempts to displace the upper torso member 14 in some direction other than rotation about the pivotal axis through shank 48. Furthermore, due to the tension of connecting member 42, the broad bearing surface of the enlarged head portion 46 abutting against the planar surface of support member 54 provides torsional resistance to rotation as well as maintaining the parts in alignment when posed. With rigid connectors often times, after repeated usage, a sloppy fit results whereby the upper torso position with respect to the lower torso is changed by the slightest touch.

While the shank portion 48 has been illustrated to be circular in cross section with a corresponding cross section of aperture 50, the configuration of the connection member 42 as depicted is not limiting inasmuch as there is no rotation of the shank 48 within the aperture 50 except for some twisting movement that may be encountered during rotation of the parts relative to each other. Essentially, the doll construction shown and described with the pivot axis about which the upper torso member 14 rotates with respect to the lower torso member 12 being angularly displaced with respect to the longitudinal center line of the torsos to provide a wide range of lifelike positions for posing the doll. While there has been shown and described a preferred embodiment it is to be understood that various other adaptations and modifications may be made within the spirit and scope of the invention.

What is claimed is:

1. A doll construction comprising:

upper torso means having a midriff portion;

lower torso means having a midriff portion;

a ball-shaped surface on the midriff portion of said lower torso means, said surface having an integrally formed bushing portion with an aperture extending therethrough, said aperture being angularly displaced with respect to the longitudinal center line of said lower torso means;

socket means at the midriff portion of said upper torso means for matingly coacting with said ball means;

a generally flexible connector member having one end fixedly secured within said lower torso means and the other end rotatably secured within said upper torso means through said aperture said bushing portion generally broadly supporting said connector member, said connector member maintaining said upper and lower torso means in tension for relative pivotal movement with respect to each other on an axis extending through the center of said aperture.

2. The combination according to claim 1 wherein said upper torso member is hollow and terminates in a lower peripheral flange having an arcuately configured edge for forming said socket means.

3. The combination according to claim 2 wherein said connector member has a shank portion extending through said bushing and an enlarged head portion and said upper torso means includes means for rotatably receiving said enlarged head portion.

4. The combination according to claim 3 wherein the axis of said shank portion is approximately 30° to the longitudinal center line of said lower torso means.

5. The combination according to claim 4 wherein said connector is made of neoprene.

6. The combination according to claim 5 wherein said the other end of said connector has an aperture engaging pin means within said lower torso means.

* * * * *